US009190727B1

(12) United States Patent
Urcia et al.

(10) Patent No.: US 9,190,727 B1
(45) Date of Patent: Nov. 17, 2015

(54) STRUCTURAL WIDEBAND MULTIFUNCTIONAL APERTURE MANUFACTURING

(71) Applicant: The Boeing Company, Chicago, IL (US)

(72) Inventors: Manny S. Urcia, Bellevue, WA (US); Charles W. Manry, Jr., Auburn, WA (US); Joseph A. Marshall, IV, Kent, WA (US); Tai A. Lam, Kent, WA (US); Otis F. Layton, Bonney Lake, WA (US)

(73) Assignee: The Boeing Company, Chicago, IL (US)

( * ) Notice: Subject to any disclaimer, the term of this patent is extended or adjusted under 35 U.S.C. 154(b) by 224 days.

(21) Appl. No.: 14/043,563

(22) Filed: Oct. 1, 2013

(51) Int. Cl.
*H01Q 1/28* (2006.01)
*H01Q 5/00* (2015.01)

(52) U.S. Cl.
CPC ..... *H01Q 5/0072* (2013.01); *H01Q 1/286* (2013.01)

(58) Field of Classification Search
CPC ... H01Q 21/00; H01Q 21/0087; H01Q 21/26; H01Q 1/286; H01Q 5/40
USPC ..... 343/705
See application file for complete search history.

(56) References Cited

U.S. PATENT DOCUMENTS

| | | | | |
|---|---|---|---|---|
| 5,786,792 | A * | 7/1998 | Bellus et al. | 343/770 |
| 6,333,712 | B1 | 12/2001 | Haugse et al. | |
| 6,650,291 | B1 * | 11/2003 | West et al. | 342/371 |
| 7,046,209 | B1 | 5/2006 | McCarville et al. | |
| 7,109,942 | B2 * | 9/2006 | McCarville et al. | 343/797 |
| 7,109,943 | B2 | 9/2006 | McCarville et al. | |
| 7,113,142 | B2 | 9/2006 | McCarville et al. | |
| 7,348,932 | B1 * | 3/2008 | Puzella et al. | 343/853 |
| 2012/0146869 | A1 * | 6/2012 | Holland et al. | 343/795 |

* cited by examiner

*Primary Examiner* — Hoang V Nguyen
(74) *Attorney, Agent, or Firm* — McDonnell Boehnen Hulbert & Berghoff LLP

(57) ABSTRACT

A structural wideband aperture assembly and methods are presented. A non-conductive structural backsheet comprises electrical vias. A structural egg-crate core comprises a grid of core strips coupled to the non-conductive structural backsheet and is configured substantially perpendicular to the non-conductive structural backsheet around open boxes. A non-structural grid of antenna feed cards is configured substantially perpendicular to the non-conductive structural backsheet and crosses the core strips. A non-structural grid of antenna feed cards comprises intersections configured within the open boxes, and electronic feed-lines aligned with the electrical vias. Antenna array unit cells comprising antenna cards coupled to the non-structural grid of antenna feed cards and configured to fit within the open boxes.

20 Claims, 14 Drawing Sheets

STRUCTURAL WIDEBAND MULTIFUNCTIONAL APERTURE MANUFACTURING

FIELD

Embodiments of the present disclosure relate generally to antenna structures. More particularly, embodiments of the present disclosure relate to manufacturing of structural antennas.

BACKGROUND

Current microwave and millimeter-wave frequency antennas generally comprise cumbersome structures such as waveguides, dish antennas, helical coils, horns, and other large non-conformal structures. Communication applications where at least one communicator is moving and radar applications generally require a steerable beam and/or steerable reception. Phased array antennas are particularly useful for beam steered applications because beam steering can be accomplished electronically without physical motion of the antenna. Such electronic beam steering can be faster and more accurate and reliable than gimbaled/motor-driven mechanical antenna steering.

SUMMARY

A structural wideband aperture assembly and methods are presented. A non-conductive structural backsheet comprises electrical vias. A structural egg-crate core comprises a grid of core strips coupled to the non-conductive structural backsheet and is configured substantially perpendicular to the non-conductive structural backsheet around open boxes. A non-structural grid of antenna feed cards is configured substantially perpendicular to the non-conductive structural backsheet and crosses the core strips. A non-structural grid of antenna feed cards comprises intersections configured within the open boxes, and antenna feed-lines aligned with the electrical vias. Antenna array unit cells comprising antenna cards are coupled to the non-structural grid of antenna feed cards and configured to fit within the open boxes.

In this manner, non-structural strips (non-structural grid of antenna feed cards) allow for use of industry standard etching and circuit boards for electrical core fabrication. The non-structural strips also provide ease of interconnects producibility as electrical adhesive has limited contact with structural adhesive. Furthermore, the structural core does not contain antenna feed lines. Thus, producibility of the structural egg-crate core can use standard square core cell processes. Additionally, individual antenna cards are fabricated per unit cell. This allows for independent testing of the antenna cards during fabrication. It also allows for simplified repair and replacement.

Individual dielectric layers are fabricated per unit cell to preserve the structural outer facesheet or radome. Three sets of electronics are used as electronics boards for coupling a plurality of Radio Frequency (RF) electronics comprising, for example but without limitation, limiters, Transmit/Receive (T/R) switches, amplifiers, phase shifters, and other components attached to a non-conductive structural backsheet. Furthermore, the antenna feed cards are attached to the non-conductive structural backsheet to provide signals and grounding from the electronic support board and electronics to the antenna card. Also, electronics cards comprising the antenna card, are attached to the antenna feed cards.

Embodiments of the disclosure provide an antenna operable to function as a structure, and comprising elements with wide bandwidth and, for example, better than 50-degree conical scan volume that can be used for creation of conformal arrays and antennas. A design approach provides effective gain that can be, for example, within 2 to 3 dB of an ideal gain possible for a surface area of a unit-cell for the antenna element. The antenna element design can be used as a wideband antenna and/or array. Embodiments of the disclosure can be used in multifunction and/or shared antenna configuration for communications, electronic warfare, and signal intelligence applications and multiple combinations of multiple applications.

Embodiments of the disclosure provide wide-bandwidth coverage, and provide polarization diversity to allow transmission and reception of signals with arbitrary polarization that may comprise, but not exclusive to linear, circular, and slant polarized signals. Embodiments of the disclosure can be scaled to a frequency band with a matching bandwidth ratio (e.g., 5:1) from a highest to a lowest frequency of desired coverage.

The antenna integration into structure provides a significant advancement of aperture technologies over traditional apertures as traditional apertures are rigid/non-load bearing members and they are not allowed to flex. This limits the size and locations of apertures onto aircraft. Integrating the aperture into the structure allows: 1) a larger size aperture as the aperture is the structure of the aircraft, 2) for more flexibility of the location of the aperture on the platform, and 3) the aperture to be installed on a variety of air, ground, or maritime vehicles adding to their mission capabilities.

In an embodiment, a structural wideband aperture assembly comprises a non-conductive structural backsheet, a structural egg-crate core, a non-structural grid of antenna feed cards, and a plurality of antenna array unit cells. The non-conductive structural backsheet comprises electrical vias. The structural egg-crate core comprises a grid of core strips coupled to the non-conductive structural backsheet and configured substantially perpendicular to the non-conductive structural backsheet around open boxes. The non-structural grid of antenna feed cards are configured substantially perpendicular to the non-conductive structural backsheet and cross the core strips. The non-structural grid of antenna feed cards comprise intersections configured within the open boxes, and comprise antenna feed-lines aligned with the electrical vias. The antenna array unit cells comprises antenna cards coupled to the non-structural grid of antenna feed cards and configured to fit within the open boxes.

In another embodiment, a method for manufacturing a wideband structural aperture assembly configures a non-conductive structural backsheet comprising one or more electrical vias. The method further couples a structural egg-crate core comprising a grid of core strips to the non-conductive structural backsheet. The method further configures the structural egg-crate core substantially perpendicular to the non-conductive structural backsheet around open boxes. The method further configures a non-structural grid of antenna feed cards substantially perpendicular to the non-conductive structural backsheet and crossing the core strips. The method further configures the non-structural grid to comprise intersections within the open boxes, and to comprise antenna feed-lines aligned with the electrical vias. The method further configures an antenna card to fit within the open boxes and comprising antenna electronics. The method further couples the antenna card to the non-structural grid of antenna feed cards.

In a further embodiment, a method for operating a wideband structural aperture assembly provides structural support with a non-conductive structural backsheet comprising one or more electrical vias. The method further provides structural support with a structural egg-crate core comprising a grid of core strips coupled to the non-conductive structural backsheet. The structural egg-crate core is configured substantially perpendicular to the non-conductive structural backsheet around a plurality of open boxes. The method further communicates electronic signals with a non-structural grid of antenna feed cards substantially perpendicular to the non-conductive structural backsheet and crossing the core strips. The non-structural grid is configured to comprise intersections within the open boxes, and to comprise antenna feed-lines aligned with the electrical vias. The method further communicates the electronic signals via the antenna feed-lines with a plurality of antenna array unit cells comprising antenna cards configured to fit within the open boxes.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
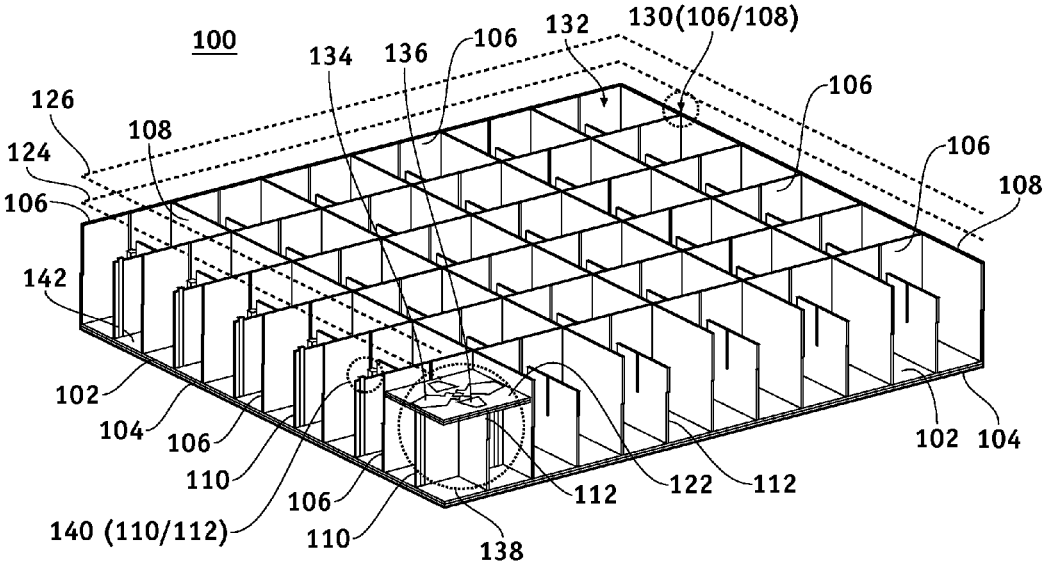
FIG. 1 is an illustration of an isometric view of an exemplary structural wideband multifunctional aperture comprising an array of unit cells in an egg-crate configuration according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to antenna design, antenna manufacturing, and other functional aspects of systems described herein (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a non-limiting application, namely, a planar or conformal phased array antenna. Embodiments of the disclosure, however, are not limited to such planar or conformal phased array antenna applications, and the techniques described herein may also be utilized in other applications.

For example but without limitation, embodiments may be applicable to manned and unmanned aircraft antennas, sensor antennas, radar antennas, non-conformal antennas, non-planar antennas, and other antenna and phased array applications.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

A compact array element with wide bandwidth coverage, wide field of view better than 55 degrees from normal to an antenna face, and polarization diversity is not a capability of current designs. Co-planar broadband-antennas based on Vivaldi type (e.g., a dielectric plate metalized on both sides) antenna elements cannot scan beyond 45 degrees while maintaining their bandwidth, spiral antennas are too large or deep for practical usage, a current sheet antenna based on wire dipoles has demonstrated 9:1 bandwidth coverage but requires the use of feed posts and external Radio Frequency (RF) hybrids. Connected arrays over a ground plane have low efficiency. Spiral based elements do not provide polarization diversity. Other wide band planar elements based on similar concepts require the use of machined feed posts and 180-degree hybrids.

Embodiments of the disclosure provide an antenna element that can be used in creation of wide-band arrays and/or conformal antennas. The wide-band arrays and/or conformal antennas can achieve wide bandwidth (e.g., 5:1 ratio), can have an ability to achieve wide scan angles, and can provide both dual and separable RF polarization capability. The antennas have a wide applicability to communication utilizing phased antenna arrays, signal intelligence sensors and detection sensor arrays, wide band radar systems, and phased arrays used in electronics warfare. The antenna element can be used as a shared and/or multifunction RF antenna system. The antenna element can achieve, for example, 5:1 or better bandwidth in both voltage standing wave ratio (VSWR) and gain.

Typical aircraft structure includes sandwich panels which are composed of facesheets and structural core. The antenna elements and feed lines are integrated into the structural core area. This may result in difficulties, such as: interconnect producibility as the electrical adhesive interfaces with the structural adhesive, dependent testing of antenna elements during fabrication, and complex repair and replacement.

Figure 2A:
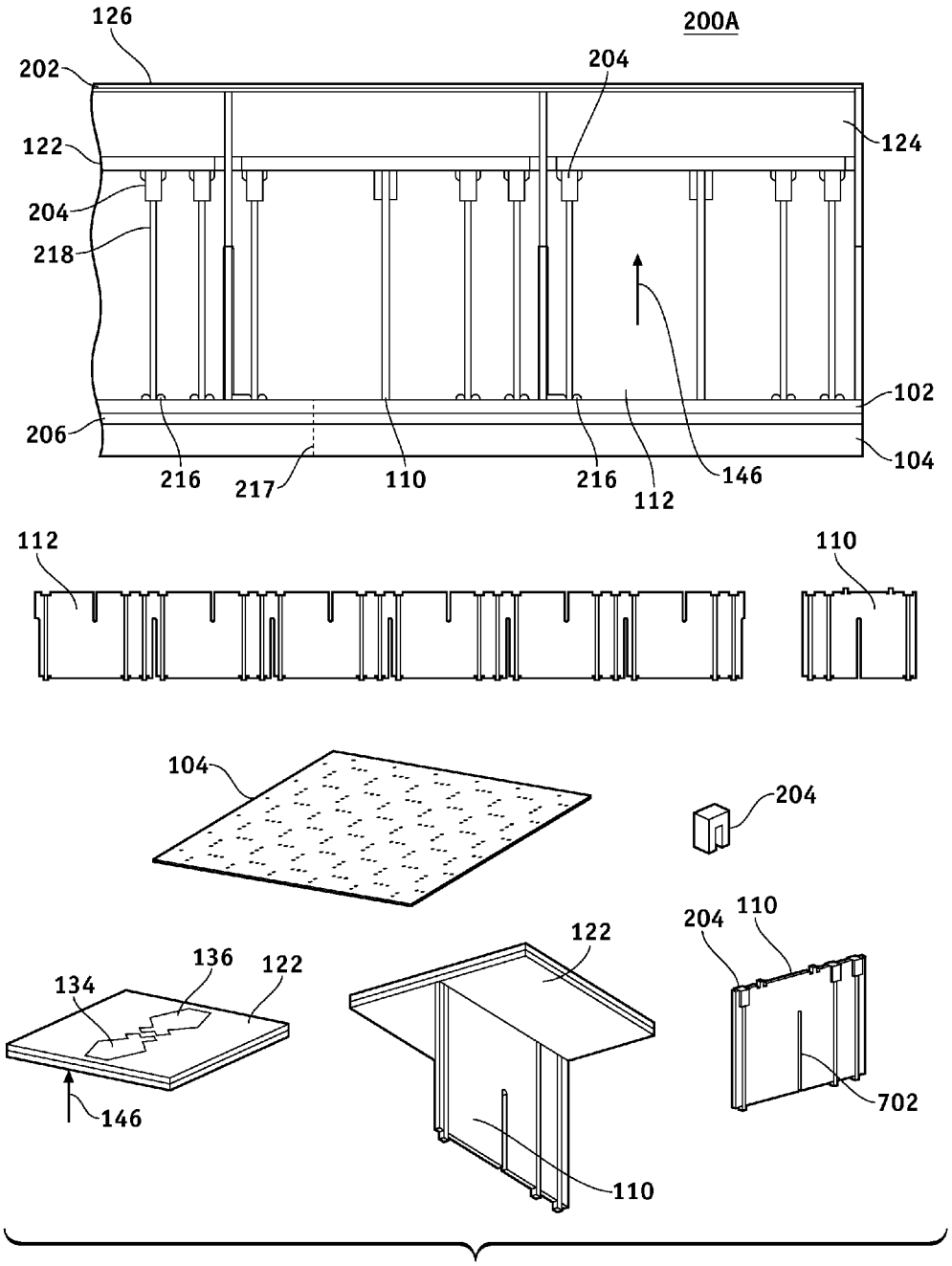
FIG. 2A is an illustration of an expanded cross-sectional front view of a portion of the structural wideband multifunctional aperture of FIG. 1 with a dielectric cover and a radome added.

FIG. 1 is an illustration of an isometric view of an exemplary structural wideband multifunctional aperture 100 (wideband structural aperture assembly 100) comprising an antenna array of unit cells 138 in a structural egg-crate core 130 configuration according to an embodiment of the disclosure. FIG. 2A is an illustration of an expanded cross-sectional front view 200A of a portion of the structural wideband multifunctional aperture 100 of FIG. 1 with a dielectric cover 124 and a radome 126 added.

The structural wideband multifunctional aperture 100 comprises the unit cells 138, a non-conductive structural backsheet 102, unsupported thin film adhesive 206 (laser trimmed rebates around RF interconnect areas), electronics support layer 104, the structural egg-crate core 130, non-structural grid of antenna feed cards 140 comprising horizontal pole electrical core strip 110 and the vertical pole electrical core strip 112, feet 216 at intersection of the vertical pole electrical core strip 112 to the unsupported thin film adhesive 206, electrical vias 217 comprising holes in the non-conductive structural backsheet 102, the unsupported thin film adhesive 206 and the electronics support layer 104, antenna feed-lines 218, RF interconnects 204, an antenna card 122, a dielectric cover 124, an unsupported thin film structural adhesive 202 (laser trimmed to grid dimensions), and a radome 126.

Non-structural grid of antenna feed cards, an electrical core, and antenna feed cards may be used interchangeably in this document. Similarly, a dielectric cover, and a dielectric layer may be used interchangeably in this document. Also radome, facesheet and structural outer facesheet may be used interchangeably in this document.

The structural egg-crate core 130 also referred to as a structural egg-crate core circuit board 130 comprises a grid of core strips 106/108 coupled to the non-conductive structural backsheet 102 and is configured substantially perpendicular to the non-conductive structural backsheet 102 around the open boxes 132. The open boxes 132 comprise and fit the unit cells 138. The grid of core strips 106/108 comprises vertical structural core strips 106 and horizontal structural core strips 108 interlocked.

The antenna array unit cells 138 are coupled to the non-conductive structural backsheet 102 and a ground plane of the electronics support layer 104 and are covered by the dielectric cover 124. The antenna array unit cells 138 comprise a phased array antenna of the structural wideband multifunctional aperture 100. The antenna array unit cells 138 each comprise the antenna card 122 comprising bow-tie antenna elements 134/136 coupled to the horizontal pole electrical core strip 110 of the non-structural grid of antenna feed cards 140 (electrical core 140) and the vertical pole electrical core strip 112 (e.g., portion of the vertical pole electrical core strip 112 within the open box 132) of the electrical core 140 respectively. Antenna array of unit cells, antenna array unit cells, and unit cells may be used interchangeably in this document.

In an alternate embodiment, the exemplary structural wideband multifunctional aperture 100 and the unit cell 138 may be comprised of only one set of antenna elements (134 or 136) to form a single polarized aperture. Antenna elements and bow-tie antenna elements may be used interchangeably in this document. In alternate embodiments, the antenna elements 134 and/or 136 may comprise various shapes. For example but without limitation, shape of the antenna elements 134 and/or 136 may be rectangular, trapezoidal, square, circular, oval, or other shape suitable for operation of the structural wideband multifunctional aperture 100. In some embodiments, the antenna card 122 may comprise multiple layers and materials.

The non-conductive structural backsheet 102 is register and cured to the structural egg-crate core 130 and is installed to the electrical core 140 at a front side 142 of the non-conductive structural backsheet 102.

Figure 3:
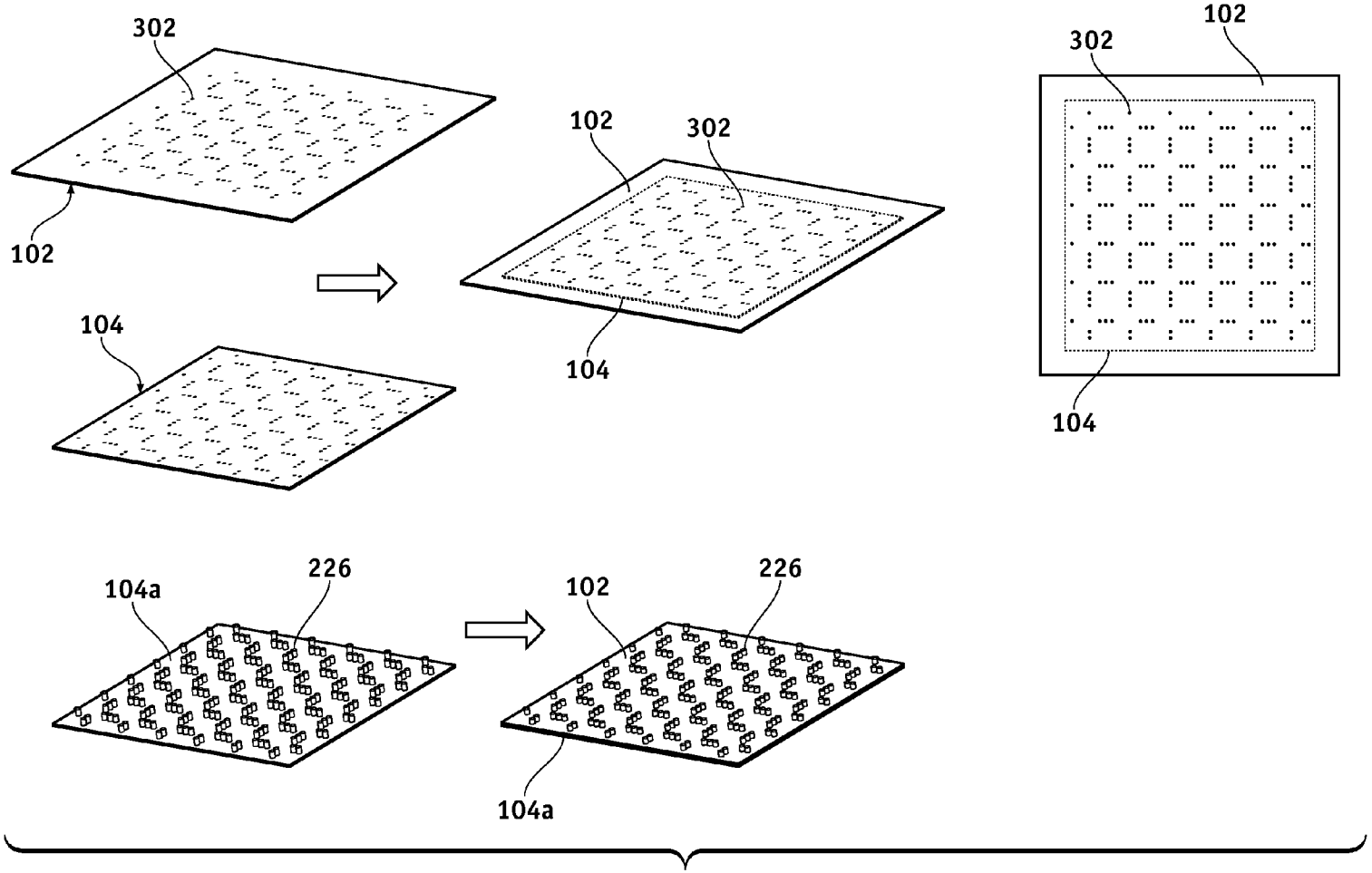
FIG. 3 is an illustration of an isometric view of a non-conductive structural backsheet and two configurations of electronics support layers of the structural wideband multifunctional aperture of FIG. 1 showing how each of the two configurations of electronics support layers are attached to the non-conductive structural backsheet.

The electronics support layer 104 is structurally coupled to the non-conductive structural backsheet 102 and is electronically coupled to the non-structural grid of antenna feed cards 140 (electrical core 140) through the electrical vias 217 comprising electrical vias 302 (FIG. 3).

The antenna feed-lines 218 are coupled to the electronics support layer 104 through the electrical vias 217. One or more electrical component packages 1104 (electronics package 1104 in FIG. 11) and a conductive ground plane may be placed on the electronics support layer 104.

The non-structural grid of antenna feed cards 140 comprises the horizontal pole electrical core pole 110 and the vertical pole electrical core strip 112 and are configured substantially perpendicular to the non-conductive structural backsheet 102 and cross the core strips 106/108 (130). The non-structural grid of antenna feed cards 140 comprise intersections 704 (FIG. 7) configured within the unit cells 138 and the open boxes 132. The non-structural grid of antenna feed cards 140 also comprise antenna feed-lines 218 (signal feed-lines 218) aligned with the electrical vias 217 which comprise electrical vias 302 (FIG. 3). The non-structural grid of antenna feed cards 140 allow for commercial off-the-shelf (COTS)/FR-4 and standard etching for fabrication of the electrical core 140. It also provides ease of interconnect producibility as the electrical adhesive does not interface with the structural adhesive.

The antenna feed-lines 218 pass through the non-conductive structural backsheet 102 thru the electrical vias 217/302.

The RF interconnects 204 couples the antenna card 122 to the non-structural grid of antenna feed cards 140. The RF interconnects 204 may comprise for example but without limitation, conductive dielectric foam spacer, conductive elastomer, or other RF interconnects. RF interconnects, and interconnects may be used interchangeably in this document.

The antenna card 122 is coupled to the non-structural grid of antenna feed cards 140, using the RF interconnects 204 in this example, and is configured to fit within the open boxes 132. The array antenna unit cells 138 comprise the antenna card 122 and may also comprise (that portion of) the non-structural grid of antenna feed cards 140 within each of the open boxes 132. The antenna card 122 comprises individual (bow-tie) antenna elements 134/136 fabricated per unit cell 138. The antenna card 122 is fabricated using a plurality of commercial off-the-shelf (COTS) materials and standard etching for fabrication. For example but without limitation, the antenna card 122 may be fabricated using FR4, a quartz fabric such as Astro-quartz, Rogers 4003™, and other compatible materials. The configuration of the antenna card 122 and the antenna feed cards 140 allows for independent testing of the antenna elements 134/136 during fabrication. The configuration of the antenna card 122 and the antenna feed cards 140 also allows for simplified repair and replacement.

Figure 2B:
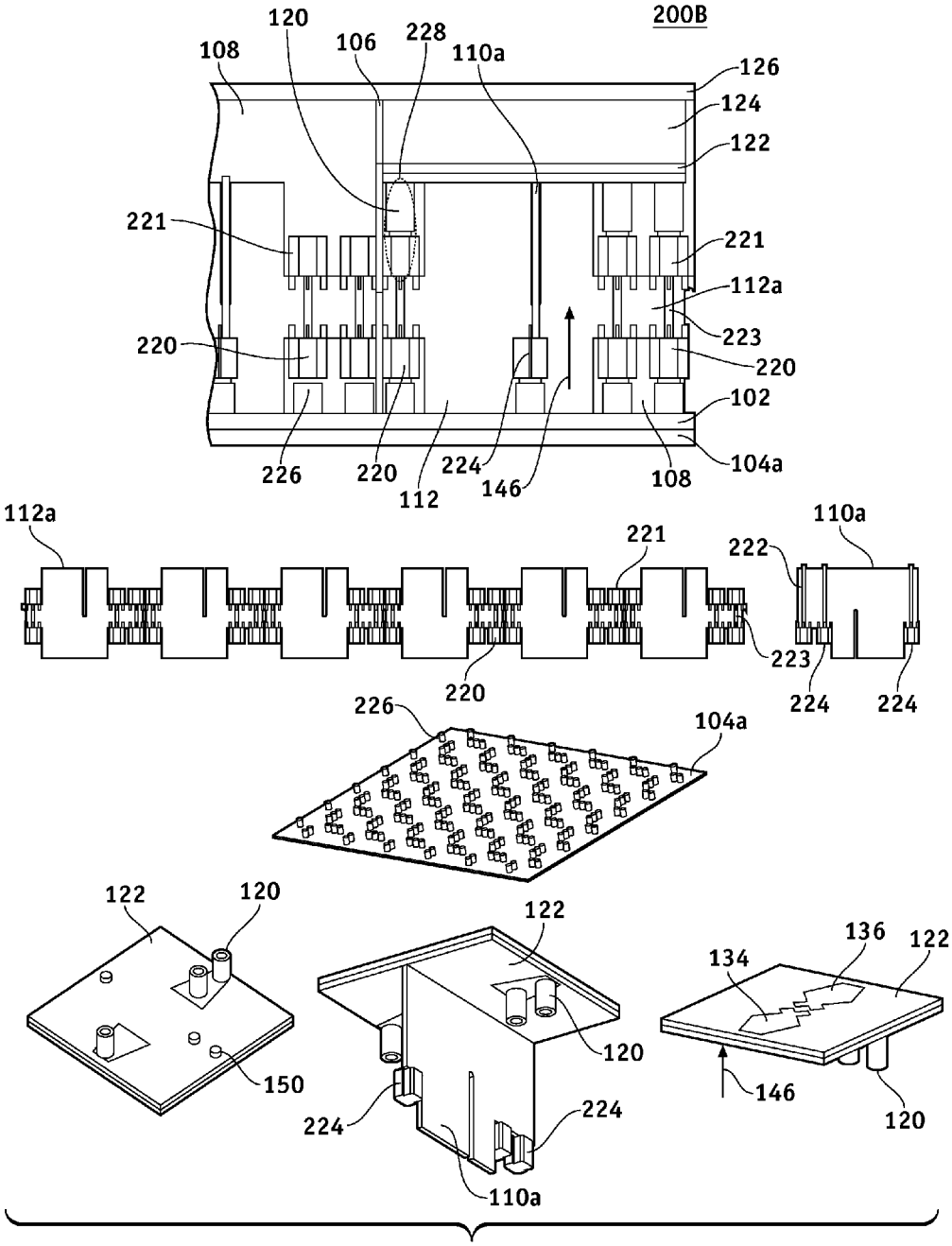
FIG. 2B is an illustration of an expanded front view of a portion of an alternate embodiment of the structural wideband multifunctional aperture of FIG. 1.
Figure 2C:
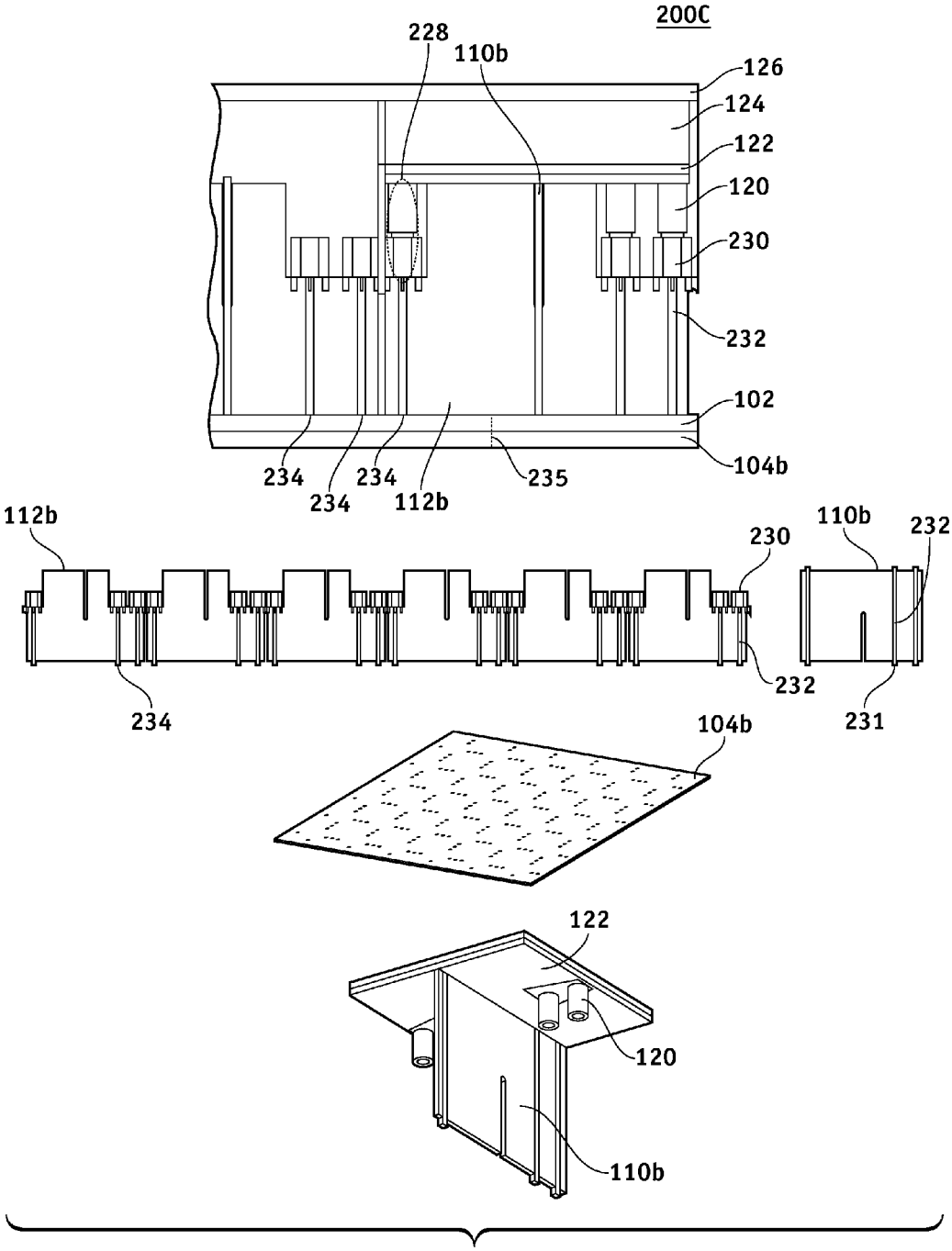
FIG. 2C is an illustration of an expanded front view of a portion of an alternate embodiment of the structural wideband multifunctional aperture of FIG. 1.

In the embodiment shown in FIG. 1, the antenna card 122 is coupled to the non-structural grid of antenna feed cards 140 using the RF interconnects 204 (FIG. 2A). Alternate embodiments of the antenna card 122 and the non-structural grid of antenna feed cards 140 are shown in FIGS. 2B and 2C below.

The dielectric cover 124, may comprise, for example but without limitation, a single layer comprising low electromagnetic loss material, a plurality of layers comprising differing low electromagnetic loss materials, or other configuration. Individual dielectric covers 124 are fabricated per unit cell 138 to preserve the radome 126 (structural outer facesheet 126). The dielectric cover 124 substantially fills a space between the antenna card 122 and the radome 126.

The open boxes 132 may be filled with a low dielectric material comprising, for example but without limitation, a low dielectric foam, an aerogel, a Safe Emulsion Agar gel (SEAgel), or other low dielectric constant material. The structural wideband multifunctional aperture 100 can function as a structural sandwich panel as a load-bearing member. For example, the structural wideband multifunctional aperture 100 may comprise an aircraft skin. The structural wideband multifunctional aperture 100 is not limited for integration into an aircraft skin, and skin of other vehicles such as, but without limitation, manned and unmanned ground vehicles, spacecraft, submarines, or other vehicles, may also be used to conform the structural wideband multifunctional aperture 100 thereto.

The structural wideband multifunctional aperture 100 (sandwich panel 100) may be integrated into a structure of a vehicle such as an aircraft. For example, the structural wideband multifunctional aperture 100 may be integrated into an outer composite skin of the aircraft. Furthermore, the electronics component package 1104 (FIG. 11) may be attached to a backside 1102 (FIG. 11) behind the non-conductive structural backsheet 102. The structural wideband multifunctional aperture 100 is configured to function under a structural loading of the aircraft. Furthermore, the antenna elements 134/136, the signal feed-lines 218, and other interconnects, connections, and electronics are configured to function under a structural loading of the aircraft.

FIG. 2A is an illustration of an expanded cross-sectional front view of a portion of the structural wideband multifunctional aperture 100 with a dielectric cover and a radome added.

FIG. 2B is an illustration of an expanded front view 200B of a portion of an alternate embodiment of the structural wideband multifunctional aperture 100. In this embodiment, the non-structural grid of antenna feed cards 140 comprise: horizontal pole electrical core strip 110*a*, and the vertical pole electrical core strip 112*a* coupled to an electronic support layer 104*a*.

The electronic support layer 104*a* is structurally coupled to the non-conductive structural backsheet 102 and is electronically coupled to the non-structural grid of antenna feed cards 140 (electrical core 140) through electrical interconnects 226 and the electrical vias 302 (FIG. 3).

The non-structural grid of antenna feed cards 140 comprises the horizontal pole electrical core pole 110*a* and the vertical pole electrical core strip 112*a* and are configured substantially perpendicular to the non-conductive structural backsheet 102 and cross the core strips 106/108. The non-structural grid of antenna feed cards 140 comprise intersections 704 (FIG. 7) configured within the unit cells 138 and the open boxes 132, and comprise the antenna feed-lines 222 that pass through the non-conductive structural backsheet 102 thru the connectors 226 and the electrical vias 302.

The horizontal pole electrical core pole 110*a* comprises connectors 224 (feet 224) and the antenna feed-lines 222. The connectors 224 insert into the structural non-conductive structural backsheet 102 thru the connectors 226 and the electrical vias 302. The antenna feed-lines 222 couple to the antenna card 122 through connectors 150 (FIG. 2B).

The vertical pole electrical core strip 112*a* comprises lower connectors 220 and upper connectors 221 and the antenna feed-lines 223 coupled therebetween. The lower connectors 220 are coupled to the structural non-conductive structural backsheet 102 thru the connectors 226 and the electrical vias 302 (FIG. 3). The upper connectors 221 are coupled to the antenna card 122 through the connectors 120. For example but without limitation, the lower connectors 220, the upper connectors 221, the feet 224, and the connectors 226 may comprise Gilbert Corning G4PO™ push-on RF interconnects.

FIG. 2C is an illustration of an expanded front view 200C of a portion of an alternate embodiment of the structural wideband multifunctional aperture 100. In this embodiment, the non-structural grid of antenna feed cards 140 comprise: horizontal pole electrical core strip 110*b* and the vertical pole electrical core strip 112*b* coupled to an electronic support layer 104*b*.

The electronic support layer 104*b* is structurally coupled to the non-conductive structural backsheet 102 and is electronically coupled to the non-structural grid of antenna feed cards 140 (electrical core 140) through tabs 234 and the electrical vias 302 (FIG. 3).

The non-structural grid of antenna feed cards 140 comprises the horizontal pole electrical core pole 110*b* and the vertical pole electrical core strip 112*b* and are configured substantially perpendicular to the non-conductive structural backsheet 102 and cross the core strips 106/108. The non-structural grid of antenna feed cards 140 comprise intersections 704 (FIG. 7) configured within the unit cells 138 and the open boxes 132, and comprise the antenna feed-lines 232 that pass through the non-conductive structural backsheet 102 thru the tabs 234 and the electrical vias 302.

The horizontal pole electrical core pole 110*b* comprises tabs 231 and the antenna feed-lines 232. The tabs 231 are coupled to the non-conductive structural backsheet 102 and the electrical vias 235 and 302. The antenna feed-lines 232 are coupled to the antenna card 122 through the connectors 120 and 230 (combined connector 228) (FIG. 2C).

The vertical pole electrical core strip 112*b* comprises upper connectors 230, the tabs 234 and the antenna feed-lines 232 coupled therebetween. The tabs 234 couple to the non-conductive structural backsheet 102 thru the electrical vias 235 and 302. The upper connectors 230 are coupled to the antenna card 122 through the connectors 120.

FIG. 3 is an illustration of an isometric view of a non-conductive structural backsheet 102 and two configurations of electronics support layers 104 and 104*a* of the structural wideband multifunctional aperture 100 of FIG. 1 showing how each of the two configurations of electronics support layers 104 and 104*a* are attached to the non-conductive structural backsheet 102. The non-conductive structural backsheet 102 may comprise, for example but without limitation, CE/AQ, FR-4, or other material. The electronics support layers 104 and 104*a* may comprise of a plurality of layers such as Rogers 4003™, or other material. The non-conductive structural backsheet 102 comprises electrical vias 302 for electrical feed. The electrical vias 302 may comprise, for example but without limitation, about 0.152 cm (about 0.060 inches) diameter, about 0.102 cm (about 0.040 inches) diameter, or other suitable diameter.

Figure 5:
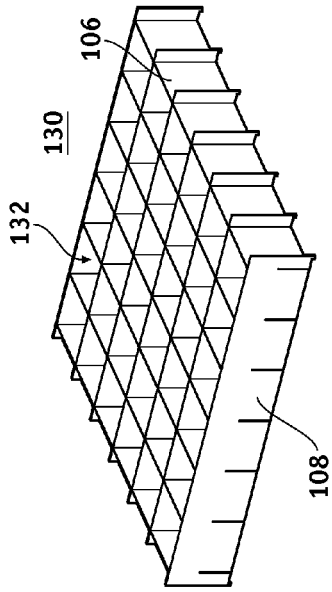
FIG. 5 is an illustration of an isometric view of an exemplary structural egg-crate core of the structural wideband multifunctional aperture of FIG. 1 assembled by a grid of structural core strips of the FIG. 4.
Figure 4:
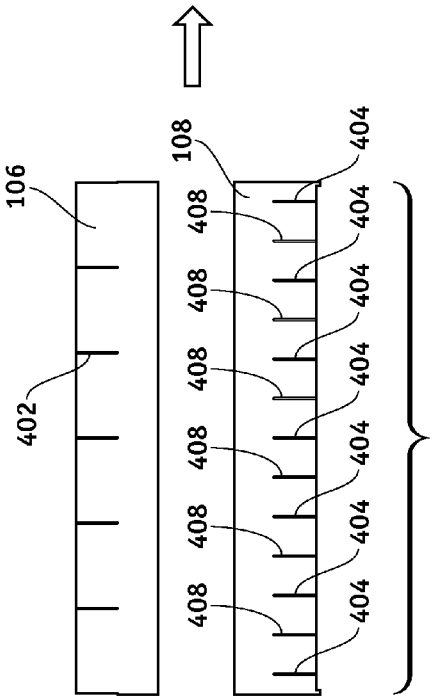
FIG. 4 is an illustration of exemplary structural core strips of the structural wideband multifunctional aperture of FIG. 1.
Figure 5A:
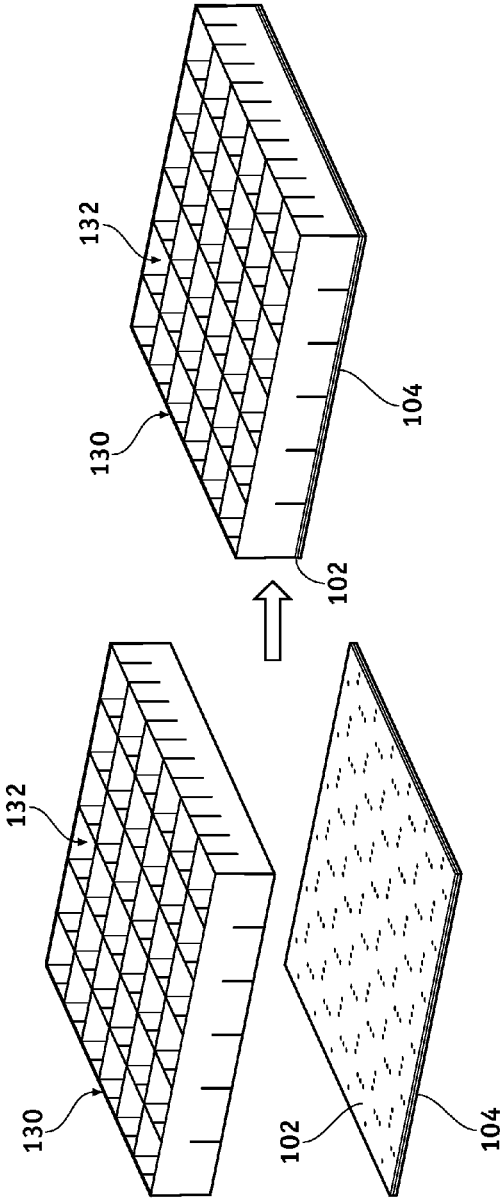
FIG. 5A is an illustration of an isometric view of the exemplary structural egg-crate core of FIG. 5 showing how the structural egg-crate core is attached to the non-conductive structural backsheet and the electronics electronic support layer of the FIG. 3.

FIG. 4 is an illustration of exemplary structural core strips 106 and 108 of the structural wideband multifunctional aperture 100 of FIG. 1. The vertical structural core strip 106 and the horizontal structural core strip 108 form the structural egg-crate core 130 (FIG. 1, FIG. 5 and FIG. 5A). The structural core strips 106 and 108 may comprise, for example but without limitation, CE/AQ, FR-4, or other material. The structural core strips 106 and 108 comprise machined strip slots 402 and 404 respectively for the structural egg-crate core 130 assembly. An additional set of slots 408 are used to fit the electrical card 112 to the structural core 106/108.

FIG. 5 is an illustration of an isometric view of the exemplary structural egg-crate core 130 of the structural wideband multifunctional aperture 100 of FIG. 1 assembled by the core strips 106/108 of the FIG. 4 (also see FIG. 5A). The core strips 106/108 are coupled to the non-conductive structural backsheet 102 and configured substantially perpendicular to the non-conductive structural backsheet 102 around the unit cells 138 and the open boxes 132. Each unit cell 138 (and each of the open boxes 132) may comprise a dimension Dx in an X direction and a dimension Dy in a Y direction. The unit cell 138 (and each of the open boxes 132) may be symmetric, wherein the dimension Dx and the dimension Dy equal a same length D comprising, for example but without limitation, about 24.5 mm (about 0.964 inches), or other suitable length. In other embodiments, the dimension Dx and the dimension Dy may comprise dissimilar values. As mentioned above, in contrast to existing structural wideband multifunctional apertures, the structural egg-crate core 130 (structural egg-crate core 130) does not contain feed lines. Thus, producibility of the structural egg-crate core 130 can use standard square core cell processes.

FIG. 5A is an illustration of an isometric view of the exemplary structural egg-crate core 130 of FIG. 5 showing how the structural egg-crate core 130 is attached to the non-conductive structural backsheet 102 and the electronics support layers 104 of the FIG. 3.

Figure 6:
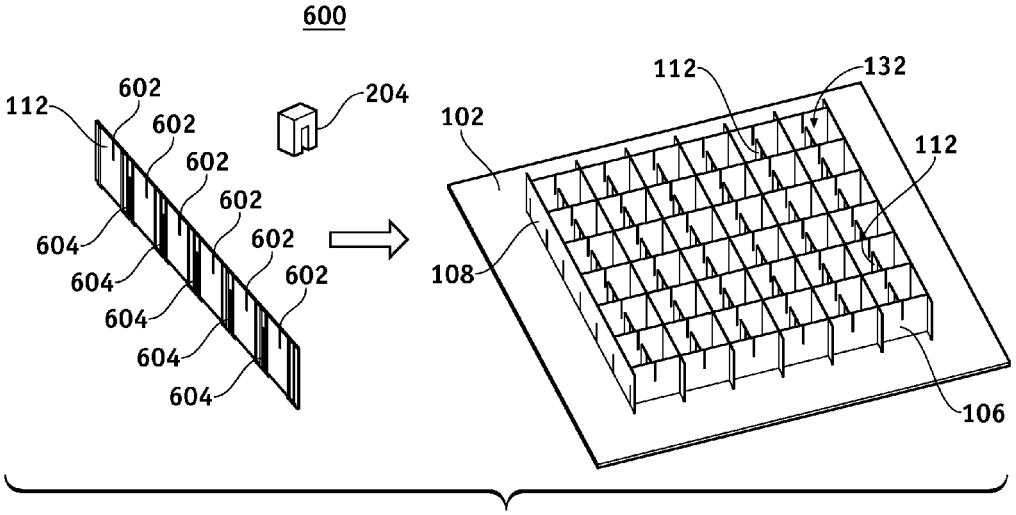
FIG. 6 is an illustration of an isometric view of an assembly showing how the non-conductive structural backsheet of FIG. 3 and vertical electrical poles with antenna feed-lines are added to the egg-crate core of FIG. 5.

FIG. 6 is an illustration of an isometric view of an assembly 600 showing how the non-conductive structural backsheet 102 and the vertical pole electrical core strip 112 are added to the structural egg-crate core 130 of FIG. 5. The structural egg-crate core 130 comprises a plurality of upper strip slots 402 (FIG. 4) configured along the core strips 106, and a plurality of lower strip slots 404/408 (FIG. 4) configured along the core strips 108. The lower strip slots 404 of the core strips 108 are fitted to the upper strip slots 402 of the core strips 106. The non-structural grid of antenna feed cards 140 (FIG. 7) comprise the antenna feed cards (strips) 112 and the antenna feed cards 110. The antenna feed cards (strips) 112 comprise a plurality of upper card slots 602 and a plurality of lower card slots 604 (FIG. 6) configured along the antenna feed cards (strips) 112. The antenna feed cards 110 comprise a plurality of lower card slots 702 (FIG. 7) configured along the antenna feed cards 110. The upper card slots 602 of the antenna feed cards (strips) 112 are fitted to the lower strip slots 408 of the core strips 108. Thereby, the antenna feed cards (strips) 112 is fitted to the structural egg-crate core 130 (also see FIG. 8). The lower card slots 702 of the antenna feed cards 110 are fitted to the upper card slots 602 of the antenna feed cards (strips) 112.

Conductive epoxy is applied within all the electrical vias 217 (FIG. 2A) comprising holes in the non-conductive structural backsheet 102, the unsupported thin film adhesive 206 and the electronics support layer 104. Adhesive is applied to an underside of the vertical pole electrical core strip 112. The vertical pole electrical core strip 112 is installed ensuring the feet 216 (FIG. 2A) at intersection of the vertical pole electrical core strip 112 to the unsupported thin film adhesive 206 (FIG. 2A) are inserted into the intersection of the vertical pole electrical core strip 112 to the unsupported thin film adhesive 206. The vertical pole electrical core strip 112 may comprise materials such as, but without limitation, CE/AQ, FR-4, Rogers 4003™, or other material. The vertical pole electrical core strip 112 may comprise the feet 216 for insertion thru the electrical vias 302 of the non-conductive structural backsheet 102. RF signals 146 from the feet 216 are coupled through the electrical vias 217 of the electronics support layer 104 to the electronics package 1104. The interconnects 204 are placed in line with the antenna feed-lines 218 and couples to the antenna card 122 (FIG. 2A). The vertical pole electrical core strip 112 is configured with machined card slot 602 for assembly.

Figure 7:
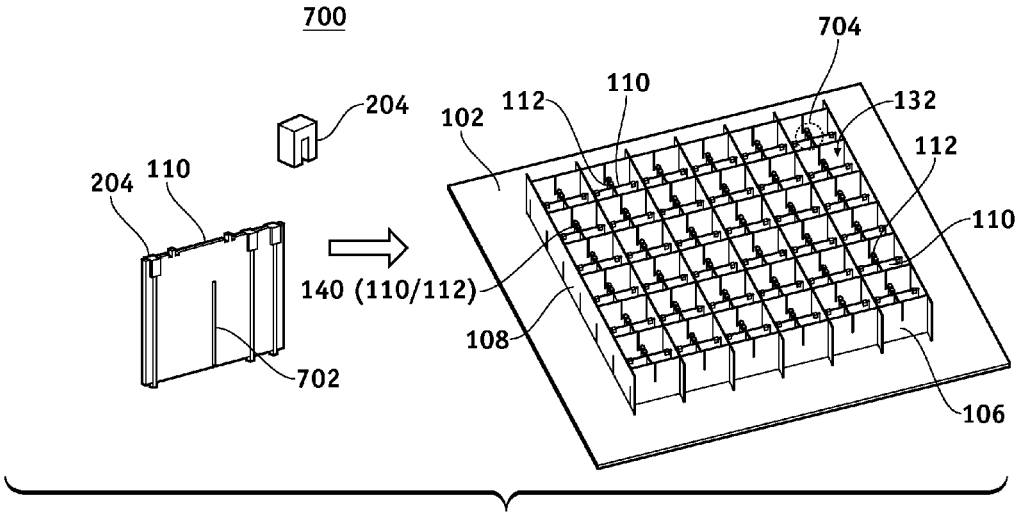
FIG. 7 is an illustration of an isometric view of an assembly showing how horizontal electrical poles with antenna feed-lines are added to the structural egg-crate core of FIG. 6.

FIG. 7 is an illustration of an isometric view of an assembly 700 showing how the horizontal pole electrical core strip 110 is added to the structural egg-crate core in the assembly 600. The horizontal pole electrical core strip 110 (antenna feed cards 110) may comprise materials such as, but without limitation, CE/AQ, FR-4 or other material. The antenna feed cards 110 comprise the lower card slots 702 configured along the antenna feed cards 110. The lower strip slots 702 of the antenna feed cards 110 are fitted to the upper card slots 602 of the antenna feed cards (strips) 112 as explained above. The horizontal pole electrical core strip 110 may comprise feet for insertion through the electrical vias 302 of the non-conductive structural backsheet 102, attached blind mate interconnects, or other connection configuration. The horizontal pole electrical core strip 110 is configured with machined card slot 702 for assembly. Adhesive is applied to an underside of the horizontal pole electrical core strip 110. The horizontal pole electrical core strip 110 is installed ensuring the feet are inserted to the electrical vias 302.

The horizontal pole electrical core strip 110 and the vertical pole electrical core strip 112 adhesives and the conductive epoxies are cured.

Figure 8:
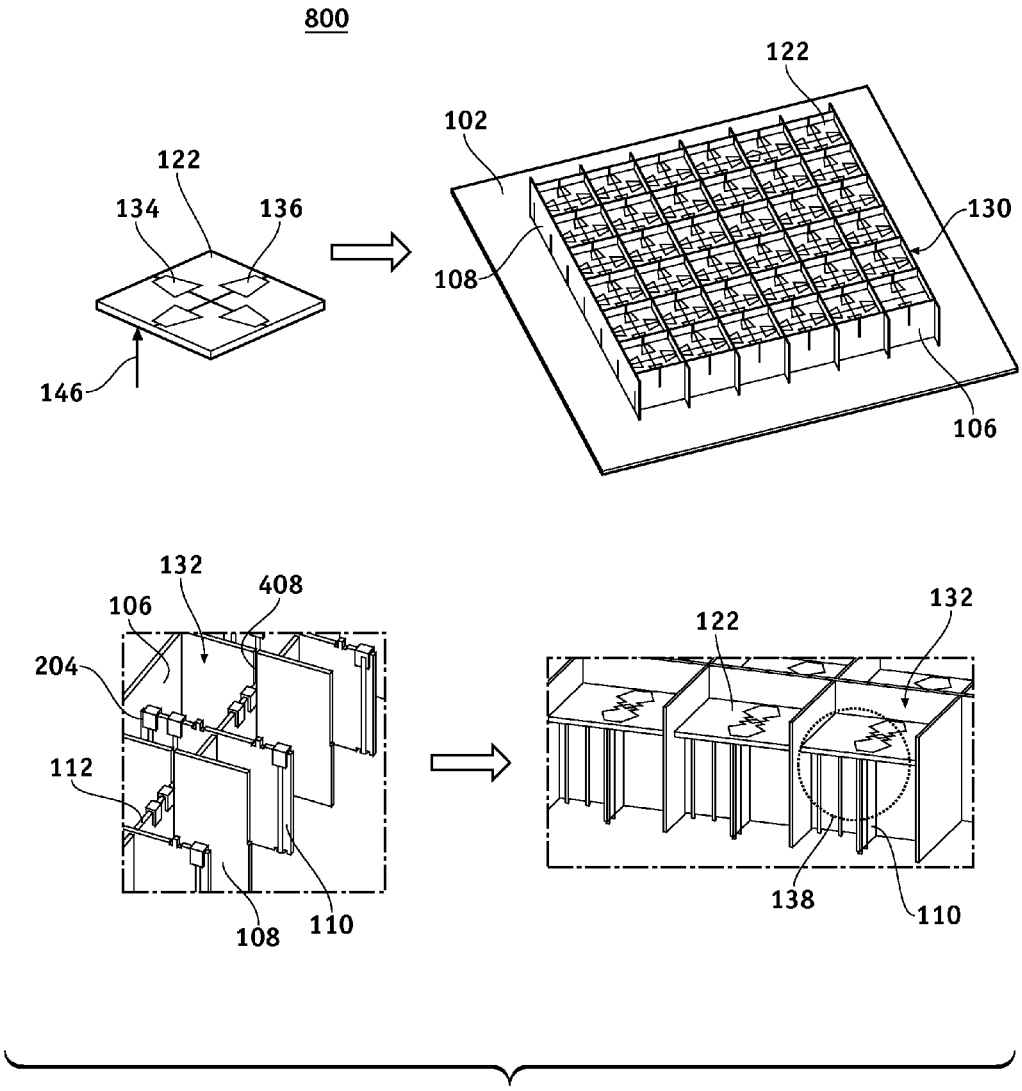
FIG. 8 is an illustration of an isometric view of an assembly showing how antenna cards are installed on an electrical core of the assembly of FIG. 7.

FIG. 8 is an illustration of an isometric view of an assembly 800 showing how the antenna card 122 is installed on the electrical core 140 of the assembly 700 of FIG. 7. The unit cells 138 each comprise the antenna card 122 comprising the (bow-tie) antenna elements 134/136 coupled to the horizontal pole electrical core strip 110. The (bow-tie) antenna elements 134/136 are coupled to the horizontal pole electrical core strip 110 though the RF interconnects 204 on the electrical core 140 and the vertical pole electrical core strip 112 of the non-structural grid of antenna feed cards 140 (electrical core 140) respectively. As mentioned above, this allows for independent testing of antenna elements 134/136 during fabrication. It also allows for simplified repair and replacement.

The structural wideband multifunctional aperture 100 comprises the antenna elements 134/136 with wide bandwidth and better than, for example, about 50-degree conical scan volume that can be used for creation of conformal arrays and antennas. The structural wideband multifunctional aperture 100 provides effective gain within, for example, about 2 to 3 dB of an ideal gain possible for a surface area of the unit cell 138 for the antenna elements 134/136. The structural wideband multifunctional aperture 100 can be used as a wideband antenna and/or array.

The structural wideband multifunctional aperture 100 may target, for example, a lower frequency wideband element. The antenna elements 134/136 allow for a structural egg-crate core configuration such as the structural structural egg-crate core circuit board 130 that enables an array of the structural wideband multifunctional aperture 100 to be designed and built to carry structural loads. The structural wideband multifunctional aperture 100 allows for a wide band array that is thin and light weight as well. There is more flexibility with a location of the structural wideband multifunctional aperture 100 on a platform such as an aircraft and a size of the structural wideband multifunctional aperture 100 has a potential to be as large as the structure is the aircraft. The ability of the structural wideband multifunctional aperture 100 to carry structural loads while providing wide bandwidth allows the aperture to be installed, without limitation, in small and medium UAV's adding to their mission capabilities they would otherwise not have.

Figure 9:
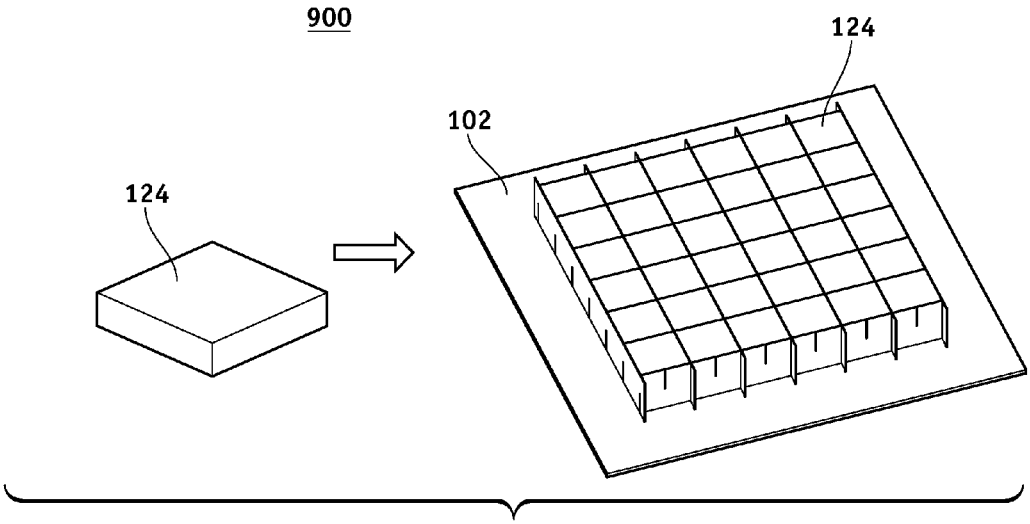
FIG. 9 is an illustration of an isometric view of an assembly showing dielectrics installed within each unit cell of the egg-crate core of the assembly of FIG. 8.

FIG. 9 is an illustration of an isometric view of an assembly 900 showing the dielectric covers 124 installed within each unit cell 138 of the structural egg-crate core 130 of the assembly 800 of FIG. 8.

Figure 10:
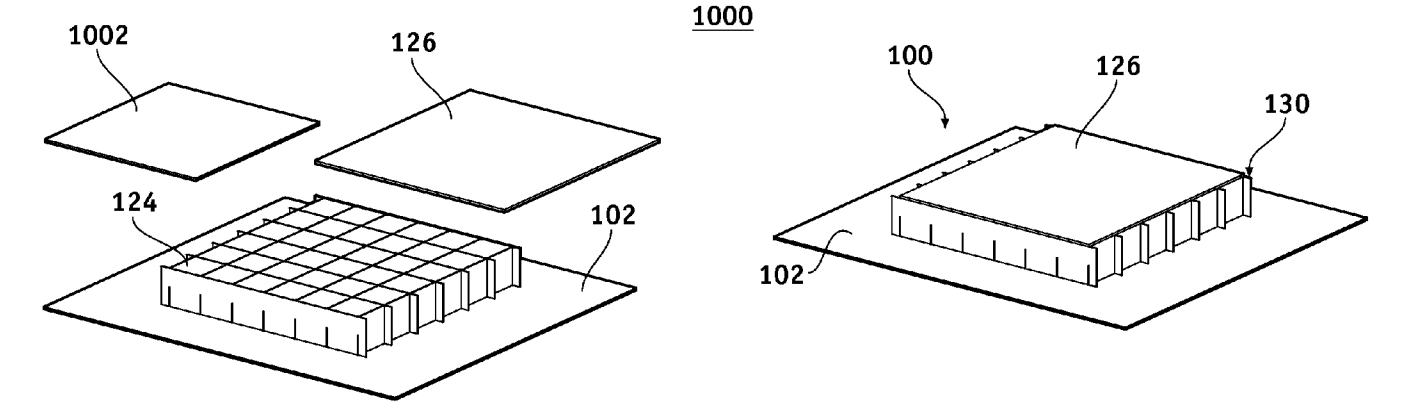
FIG. 10 is an illustration of an isometric view of an assembly showing how a radome is installed on the assembly of FIG. 9 to configure the structural wideband multifunctional aperture of FIG. 1.

FIG. 10 is an illustration of an isometric view of an assembly 1000 showing how the radome 126 is installed on the assembly 900 of FIG. 9 to configure the structural wideband multifunctional aperture of FIG. 1. Adhesive strips are installed on top of the structural egg-crate core 130, a (e.g., light weight) dielectric sheet 1002 is installed as required, radome adhesive is applied and the radome 126 is registered to the structural egg-crate core and cured. The radome 126 may comprise materials such as, but without limitation, CE/AQ, FR-4, or other suitable material.

Figure 11:
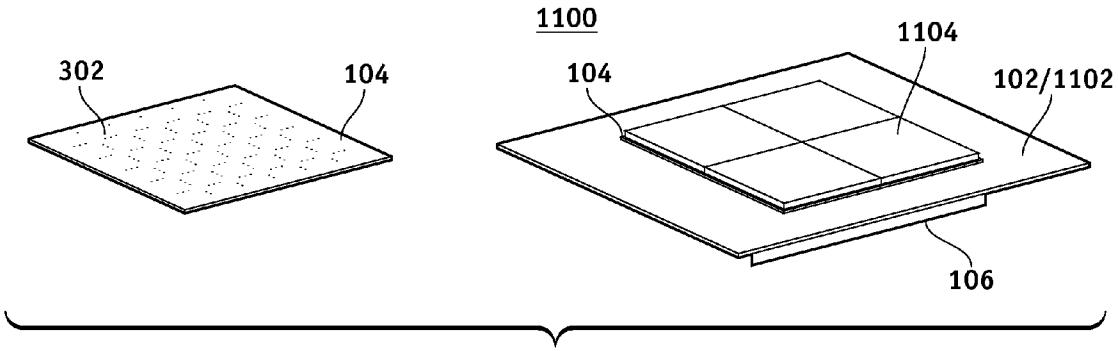
FIG. 11 is an illustration of an isometric view of back of the non-conductive structural backsheet of the assembly of FIG. 10 showing installation of an electronics support layer shown in FIG. 1 and an electronics package.

FIG. 11 is an illustration of an isometric view 1100 of back side 1102 of the non-conductive structural backsheet 102 of the assembly 1000 of FIG. 10 showing installation of the electronics support layer 104 shown in FIG. 1 and the electronics package 1104. Perforated adhesive may be used to cure the non-conductive structural backsheet 102 to the electronics support layer 104. The electronics package 1104 is coupled structurally to the non-conductive structural backsheet 102 through the electronic support layer 104. The electronics package 1104 is electronically coupled to the antenna feed cards 140 through the electrical vias 302 of the non-conductive structural backsheet 102 and the electronics support layer 104 (see also FIG. 3). The electronics package 1104 is attached after structural fabrication and may comprise smaller active electronics cards with amplifiers, phase shifters, and other components.

In operation, a structural support with a non-conductive structural backsheet 102 comprising one or more electrical vias 302 is provided. A structural support with a structural egg-crate core 130 comprising a grid of core strips 106/108 coupled to the non-conductive structural backsheet 102 is provided. The structural egg-crate core 130 is configured substantially perpendicular to the non-conductive structural backsheet 102 around the open boxes 132. The electronic signals 146 are communicated with a non-structural grid of antenna feed cards 140 substantially perpendicular to the non-conductive structural backsheet and crossing the core strips 106/108. The non-structural grid of antenna feed cards 140 are configured to comprise intersections 704 within the open boxes 132, and to comprise electronic feed-lines 218 aligned with the electrical vias 302. The electronic signals 146 are communicated via the electronic feed-lines 218 with the antenna card 122. The antenna card 122 is configured to fit within the open boxes 132 and is comprised in each of a plurality of antenna array unit cells 138 in the open boxes 132. The antenna array unit cells 138 form a phased array antenna of the structural wideband multifunctional aperture 100.

The structural wideband multifunctional aperture 100 can be used in multifunction and/or shared antenna configuration for communications, electronic warfare, and signal intelligence applications and multiple combinations of multiple applications. The structural wideband multifunctional aperture 100 not only provides wide-bandwidth coverage it also provides polarization diversity to allow the transmission and reception of signals with any arbitrary polarization that comprises, for example but without limitation linear, circular, slant polarized signals, and other polarization signal. The structural wideband multifunctional aperture 100 can be scaled to any frequency band with a matching bandwidth ratio (e.g., about, 5:1) from the highest to the lowest frequency of a desired coverage.

Figure 12:
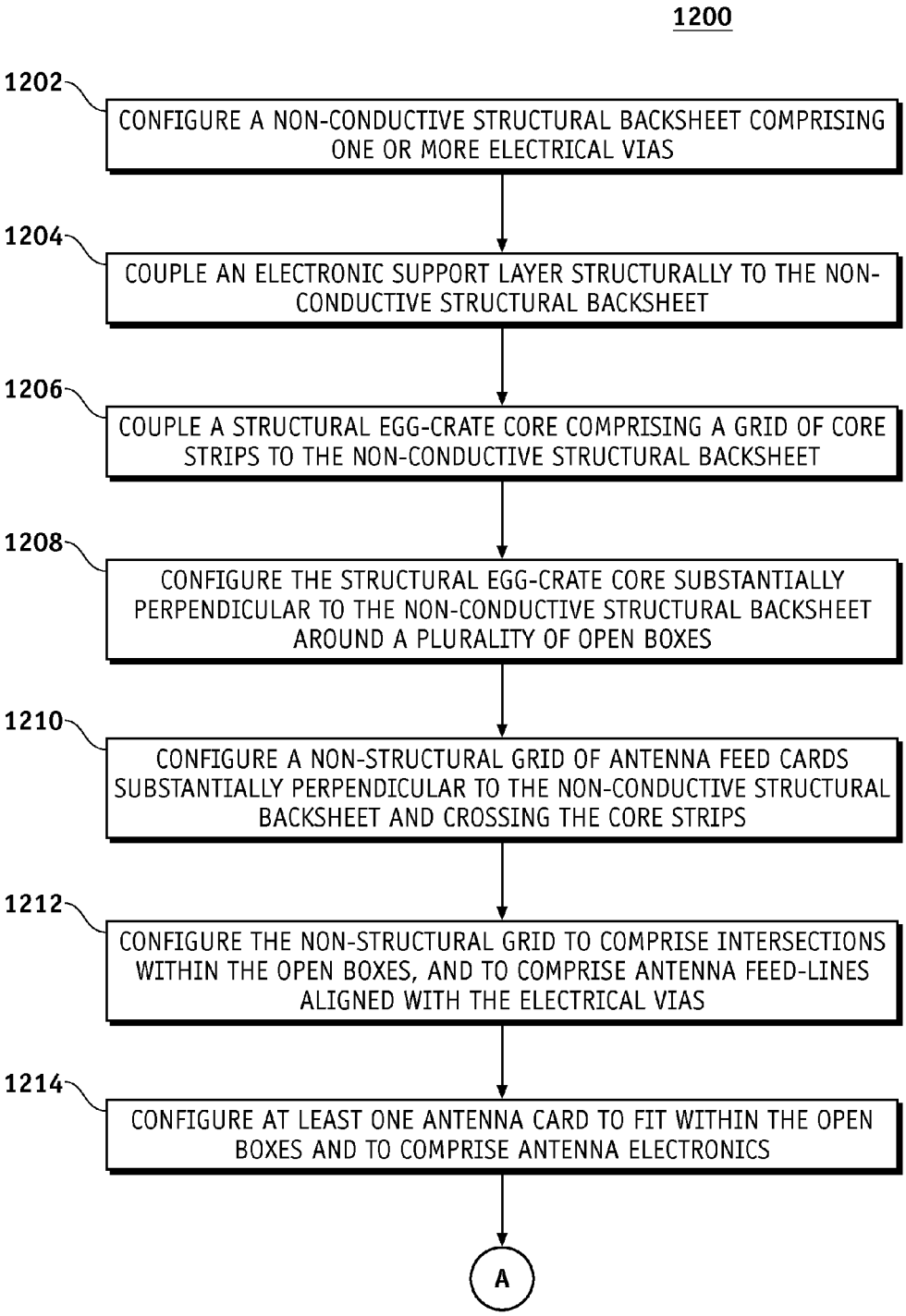
FIG. 12 is an illustration of a flowchart showing an exemplary process for manufacturing a structural wideband multifunctional aperture according to an embodiment of the disclosure.
Figure 12:
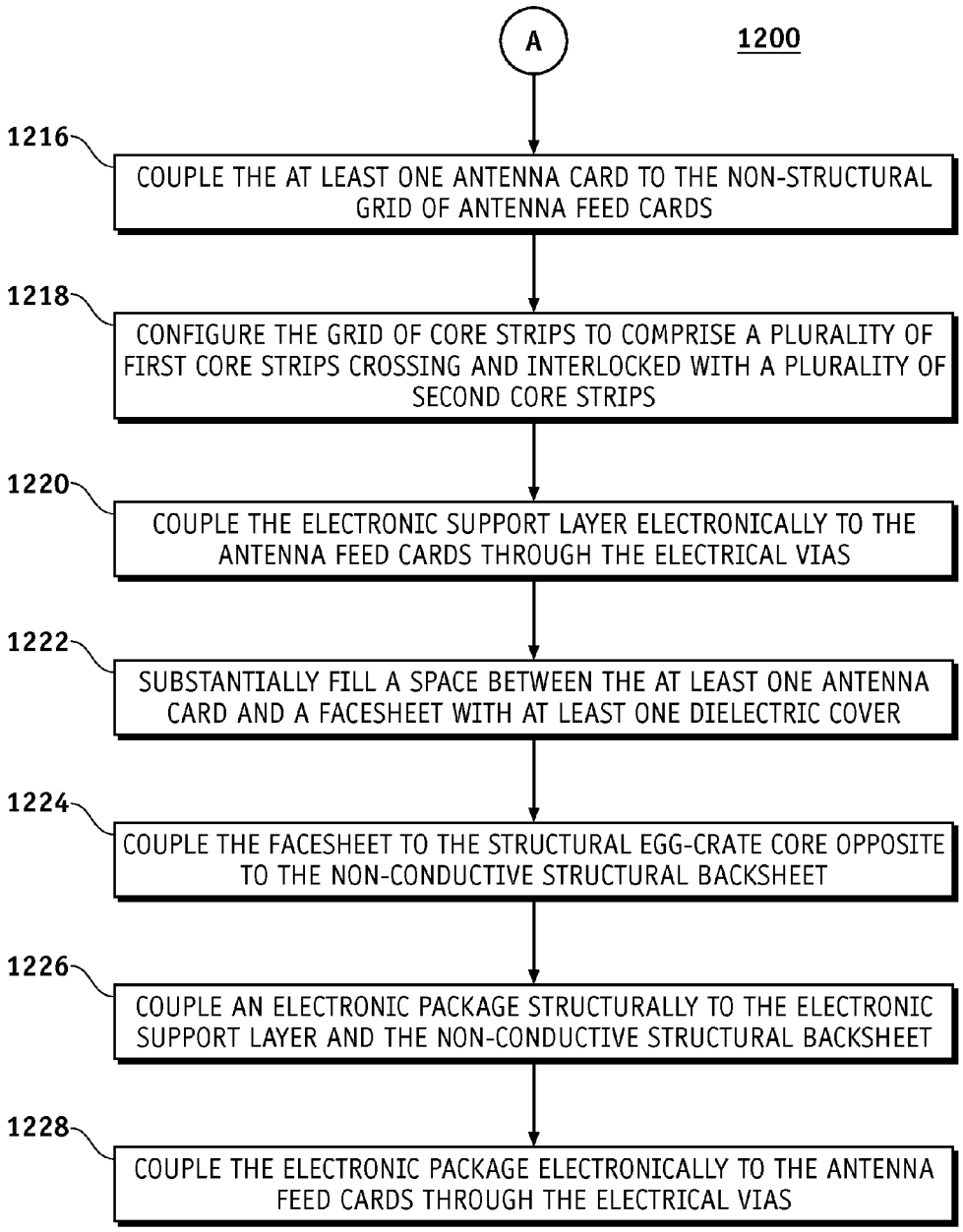

FIG. 12 is an illustration of a flowchart showing an exemplary process 1200 for manufacturing a wideband structural aperture assembly according to an embodiment of the disclosure. The various tasks performed in connection with process 1200 may be performed by software, hardware, firmware, computer-readable software, computer readable storage medium, a computer-readable medium comprising computer executable instructions for performing the process method, mechanically, or any combination thereof. The process 1200 may be recorded in a computer-readable medium such as a semiconductor memory, a magnetic disk, an optical disk, and the like, and can be accessed and executed, for example, by a computer CPU in which the computer-readable medium is stored.

For illustrative purposes, the following description of process 1200 may refer to elements mentioned above in connection with FIGS. 1-11. In some embodiments, portions of the process 1200 may be performed by different elements of the structural wideband multifunctional aperture 100 such as: the non-conductive structural backsheet 102, the electronics support layer 104, the structural egg-crate core 130, the non-structural grid of antenna feed cards 140, the antenna card 122, the dielectric cover 124, the radome 126, etc. It should be appreciated that the process 1200 may include any number of additional or alternative tasks, the tasks shown in FIG. 12 need not be performed in the illustrated order, and the process 1200 may be incorporated into a more comprehensive procedure or process having additional functionality not described in detail herein. Process 1200 may comprise functions, material, and structures that are similar to the embodiments shown in FIGS. 1-11. Therefore, common features, functions, and elements may not be redundantly described here.

Process 1200 may begin by configuring a non-conductive structural backsheet (e.g., 102) comprising one or more electrical vias 302 (task 1202).

Process 1200 may continue by coupling an electronic support layer (e.g., 104) structurally to the non-conductive structural backsheet 102 (task 1204).

Process 1200 may continue by coupling a structural egg-crate core (e.g., 130) comprising a grid of core strips (e.g., 106/108) to the non-conductive structural backsheet 102 (task 1206).

Process 1200 may continue by configuring the structural egg-crate core 130 substantially perpendicular to the non-conductive structural backsheet 102 around a plurality of open boxes (e.g., 132) (task 1208).

Process 1200 may continue by configuring a non-structural grid of antenna feed cards (e.g., 140) substantially perpendicular to the non-conductive structural backsheet 102 and crossing the core strips 106/108 (task 1210).

Process 1200 may continue by configuring the non-structural grid 140 to comprise intersections (e.g., 704) within the open boxes 132, and to comprise antenna feed-lines (e.g., 218, 222, 223, 232) aligned with the electrical vias 302 (task 1212).

Process 1200 may continue by configuring at least one antenna card (e.g., 122) to fit within the open boxes 132 and to comprise antenna electronics (task 1214).

Process 1200 may continue by coupling the at least one antenna card 122 to the non-structural grid of antenna feed cards 140 (task 1216).

Process 1200 may continue by configuring the grid of core strips 106/108 to comprise a plurality of first core strips (e.g., 106) crossing and interlocked with a plurality of second core strips (e.g., 108) (task 1218).

Process 1200 may continue by coupling the electronic support layer 104 electronically to the antenna feed cards 140 through the electrical vias 302 (task 1220).

Process 1200 may continue by substantially filling a space between the antenna card 122 and a facesheet (e.g., 126) with at least one dielectric cover (e.g., 124) (task 1222).

Process 1200 may continue by coupling the facesheet 126 to the structural egg-crate core 130 opposite to the non-conductive structural backsheet 102 (task 1224).

Process 1200 may continue by coupling an electronics package (e.g., 1104) structurally to the electronic support layer 104 and the non-conductive structural backsheet 102 (task 1226).

Process 1200 may continue by coupling the electronics package 1104 electronically to the antenna feed cards 140 through the electrical vias 302 (task 1228).

Figure 13:
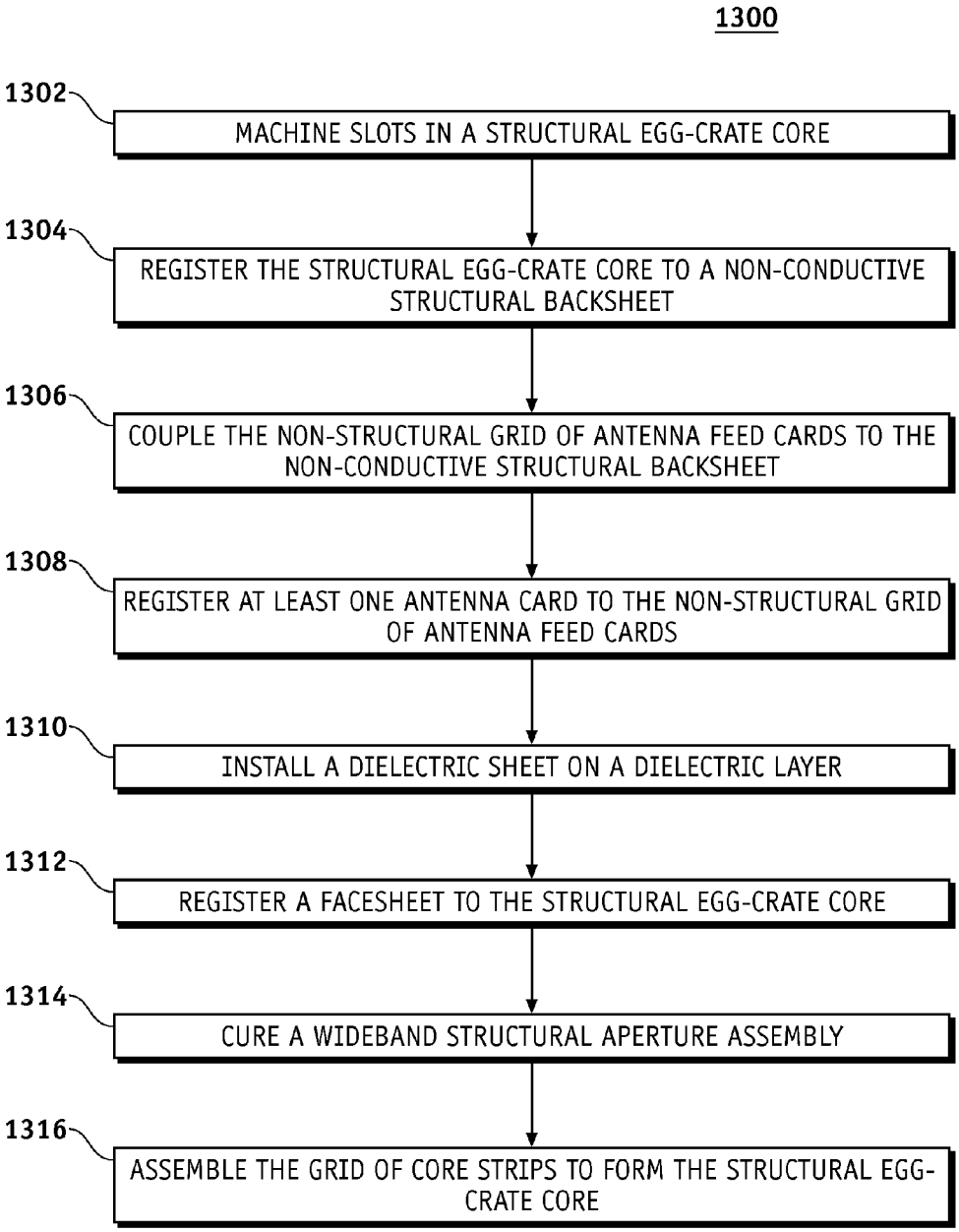
FIG. 13 is an illustration of a flowchart showing an exemplary process for manufacturing a structural wideband multifunctional aperture according to an embodiment of the disclosure.

FIG. 13 is an illustration of a flowchart showing an exemplary process 1300 for manufacturing a structural wideband multifunctional aperture according to an embodiment of the disclosure. The various tasks performed in connection with process 1300 may be performed mechanically, by software, hardware, firmware, computer-readable software, computer readable storage medium, or any combination thereof. The process 1300 may be recorded in a computer-readable medium such as a semiconductor memory, a magnetic disk, an optical disk, and the like, and can be accessed and executed, for example, by a computer CPU in which the computer-readable medium is stored.

For illustrative purposes, the following description of process 1300 may refer to elements mentioned above in connection with FIGS. 1-11. In some embodiments, portions of the process 1300 may be performed by different elements of the structural wideband multifunctional aperture 100 such as: the unit cells 138, the non-conductive structural backsheet 102, the electronics support layer 104, the structural egg-crate core 130, the non-structural grid of antenna feed cards 140, the antenna card 122, the dielectric cover 124, the radome 126, etc. It should be appreciated that process 1300 may include any number of additional or alternative tasks, the tasks shown in FIG. 13 need not be performed in the illustrated order, and the process 1300 may be incorporated into a more comprehensive procedure or process having additional functionality not described in detail herein.

Process 1300 may begin by machining slots (e.g., 402/406/408) in a structural egg-crate core (e.g., 130) (task 1302).

Process 1300 may continue by registering the structural egg-crate core 130 to the non-conductive structural backsheet (e.g., 102) (task 1304).

Process 1300 may continue by coupling the non-structural grid of antenna feed cards (e.g., 140) to the non-conductive structural backsheet 102 (task 1306).

Process 1300 may continue by registering at least one antenna card (e.g., 122) to the non-structural grid of antenna feed cards 140 (task 1308).

Process 1300 may continue by installing a light weight dielectric sheet (e.g., 126) on a dielectric layer (e.g., 124) (task 1310).

Process 1300 may continue by registering a facesheet (e.g., 126) to the structural egg-crate core 130 (task 1312).

Process 1300 may continue by curing the wideband structural aperture assembly 100 (task 1314). Curing the wideband structural aperture assembly 100 may comprise, for example but without limitation, heat treating the wideband structural aperture assembly 100 to fuse components of the wideband structural aperture assembly 100 such as structural composite materials of the structural egg-crate core, fuse solder connections, or other components that require curing.

Process 1300 may continue by assembling a grid of core strips (e.g., 106/108) to form the structural egg-crate core 130 (task 1316).

Figure 14:
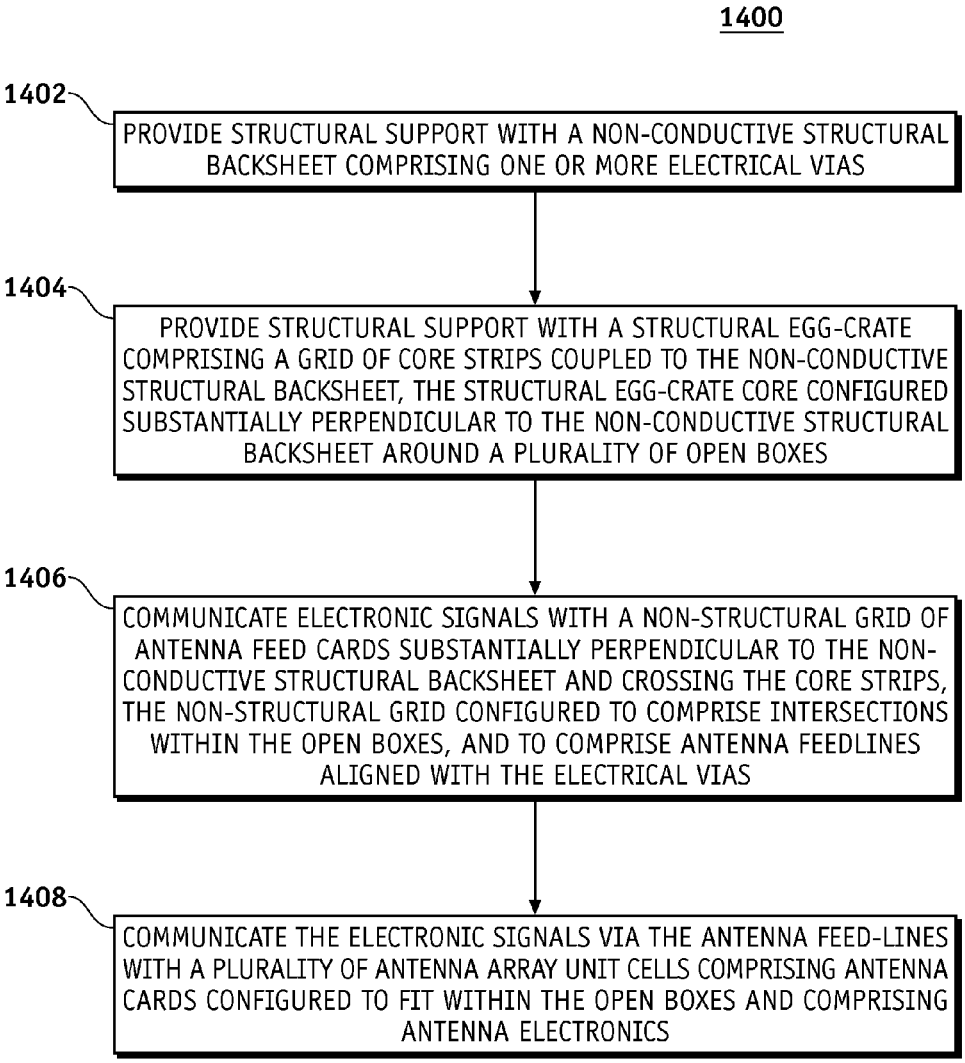
FIG. 14 is an illustration of a flowchart showing an exemplary process for operating a structural wideband multifunctional aperture according to an embodiment of the disclosure.

FIG. 14 is an illustration of a flowchart showing an exemplary process 1400 for operating a wideband structural aperture assembly according to an embodiment of the disclosure. The various tasks performed in connection with process 1400 may be performed mechanically, by software, hardware, firmware, computer-readable software, computer readable storage medium, or any combination thereof. The process 1400 may be recorded in a computer-readable medium such as a semiconductor memory, a magnetic disk, an optical disk, and the like, and can be accessed and executed, for example, by a computer CPU in which the computer-readable medium is stored.

For illustrative purposes, the following description of process 1400 may refer to elements mentioned above in connection with FIGS. 1-11. In some embodiments, portions of the process 1400 may be performed by different elements of the structural wideband multifunctional aperture 100 such as: the unit cells 138, the non-conductive structural backsheet 102, the electronics support layer 104, the structural egg-crate core 130, the non-structural grid of antenna feed cards 140, the antenna card 122, the dielectric cover 124, the radome 126, etc. It should be appreciated that process 1400 may include any number of additional or alternative tasks, the tasks shown in FIG. 14 need not be performed in the illustrated order, and the process 1400 may be incorporated into a more comprehensive procedure or process having additional functionality not described in detail herein.

Process 1400 may begin by providing structural support with (by using) a non-conductive structural backsheet (e.g., 102) comprising one or more electrical vias 302 (task 1402).

Process 1400 may continue by providing structural support with (by using) a structural egg-crate core (e.g., 130) comprising a grid of core strips (e.g., 106/108) coupled to the non-conductive structural backsheet 102, the structural egg-crate core 130 configured substantially perpendicular to the non-conductive structural backsheet 102 around a plurality of open boxes (e.g., 132) (task 1404).

Process 1400 may continue by communicating electronic signals (e.g., 146) with (e.g., to and from) a non-structural grid of antenna feed cards (e.g., 140) substantially perpendicular to the non-conductive structural backsheet 102 and crossing the core strips 106/108, the non-structural grid 140 configured to comprise intersections (e.g., 704) within the open boxes (e.g., 132), and to comprise electronic feed-lines (e.g., 218, 222, 223, 232) aligned with the electrical vias 302 (task 1406).

Process 1400 may continue by communicating the electronic signals 146 via the electronic feed-lines 218/222/223/232 with (e.g., to and from) a plurality of antenna array unit cells (e.g., 138) comprising antenna cards (e.g., 122) configured to fit within the open boxes 132 (task 1408).

In this manner, embodiments of the disclosure provide a wideband structural aperture assembly that can be used in creation of wide-band arrays and/or conformal antennas. Embodiments provide, a non-structural grid of antenna feed cards which allow for COTS/FR-4 and standard etching for electrical core fabrication. The non-structural grid of antenna feed cards also provide ease of interconnects producibility as electrical adhesive does not interface with structural adhesive. Furthermore, the structural egg-crate core does not contain feed-lines. Thus, producibility can use standard square core cell processes. Additionally, individual antenna cards are fabricated per unit cell. This allows for independent testing of the antenna cards during fabrication. It also allows for simplified repair and replacement. Individual dielectric layers are fabricated per unit cell to preserve the structural outer facesheet or radome.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-8 depict example arrangements of elements, additional intervening elements, devices, features, or components may be present in an embodiment of the disclosure.

As used herein, unless expressly stated otherwise, "substantially" means may comprise a minor deviation due to measuring devices, fabrication processes, testing environments, material properties, or similar factors. For example, substantially perpendicular means may comprise a minor deviation from a 90 degree angle. Similarly, substantially parallel means may comprise a minor deviation from being parallel.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. A structural wideband aperture assembly comprising:

a non-conductive structural backsheet comprising one or more electrical vias;

a structural egg-crate core comprising a grid of core strips coupled to the non-conductive structural backsheet and configured substantially perpendicular to the non-conductive structural backsheet around a plurality of open boxes;

a non-structural grid of antenna feed cards configured substantially perpendicular to the non-conductive structural backsheet and crossing the core strips, and comprising intersections configured within the open boxes, and comprising antenna feed-lines aligned with the electrical vias; and a plurality of antenna array unit cells comprising at least one antenna card coupled to the non-structural grid of antenna feed cards and configured to fit within the open boxes.

2. The structural wideband aperture assembly of claim 1, wherein the grid of core strips comprises a plurality of first core strips crossing and interlocked with a plurality of second core strips.

3. The structural wideband aperture assembly of claim 1, further comprising an electronics package coupled structurally to the non-conductive structural backsheet and electronically coupled to the antenna feed cards through the electrical vias.

4. The structural wideband aperture assembly of claim 1, further comprising a facesheet coupled to the structural egg-crate core opposite to the non-conductive structural backsheet.

5. The structural wideband aperture assembly of claim 4, further comprising at least one dielectric cover substantially filling a space between the antenna card and the facesheet.

6. The structural wideband aperture assembly of claim 1, wherein:

the structural egg-crate core comprises a plurality of strip slots configured along the core strips;

the non-structural grid of antenna feed cards comprises a plurality of card slots configured along the antenna feed cards; and the card slots are fitted into the strip slots.

7. The structural wideband aperture assembly of claim 1, wherein the structural wideband aperture assembly comprises an aircraft skin, and is configured to bear loads on the aircraft skin.

8. A method for manufacturing a wideband structural aperture assembly, the method comprising:

configuring a non-conductive structural backsheet comprising one or more electrical vias;

coupling a structural egg-crate core comprising a grid of core strips to the non-conductive structural backsheet;

configuring the structural egg-crate core substantially perpendicular to the non-conductive structural backsheet around a plurality of open boxes;

configuring a non-structural grid of antenna feed cards substantially perpendicular to the non-conductive structural backsheet and crossing the core strips;

configuring the non-structural grid to comprise intersections within the open boxes, and to comprise antenna feed-lines aligned with the electrical vias;

configuring at least one antenna card to fit within the open boxes and to comprise antenna electronics; and coupling the at least one antenna card to the non-structural grid of antenna feed cards.

9. The method of claim 8, further comprising configuring the grid of core strips to comprise a plurality of first core strips crossing and interlocked with a plurality of second core strips.

10. The method of claim 8, further comprising:

coupling an electronic support layer structurally to the non-conductive structural backsheet; and coupling the electronic support layer electronically to the antenna feed cards through the electrical vias.

11. The method of claim 10, further comprising:

coupling an electronics package structurally to the electronic support layer and the non-conductive structural backsheet; and coupling the electronics package electronically to the antenna feed cards through the electrical vias.

12. The method of claim 8, wherein:

the structural egg-crate core comprises a plurality of strip slots configured along the core strips;

the non-structural grid of antenna feed cards comprises a plurality of card slots configured along the antenna feed cards; and the card slots are fitted into the strip slots.

13. The method of claim 8, further comprising coupling a facesheet to the structural egg-crate core opposite to the non-conductive structural backsheet.

14. The method of claim 13, further comprising substantially filling a space between the antenna card and the facesheet with at least one dielectric cover.

15. The method of claim 8, further comprising:

machining slots in the structural egg-crate core;

registering the structural egg-crate core to the non-conductive structural backsheet comprising electrical vias;

assembling the grid of core strips to form the structural egg-crate core;

coupling the non-structural grid of antenna feed cards to the non-conductive structural backsheet;

registering the at least one antenna card to the non-structural grid of antenna feed cards;

installing a dielectric sheet on a dielectric layer;

registering a facesheet to the structural egg-crate core; and curing the wideband structural aperture assembly.

16. The method of claim 8, wherein:

the non-structural grid of antenna feed cards comprises a plurality of card slots configured along the antenna feed cards; and the card slots are fitted into the slots.

17. The method of claim 8, wherein the grid of core strips comprises a plurality of first core strips crossing and interlocked with a plurality of second core strips.

18. The method of claim 8, wherein the wideband structural aperture assembly comprises an aircraft skin, and is configured to bear loads on the aircraft skin.

19. A method for operating a wideband structural aperture assembly, the method comprising:

providing structural support with a non-conductive structural backsheet comprising one or more electrical vias;

providing structural support with a structural egg-crate core comprising a grid of core strips coupled to the non-conductive structural backsheet, the structural egg-crate core configured substantially perpendicular to the non-conductive structural backsheet around a plurality of open boxes;

communicating electronic signals with a non-structural grid of antenna feed cards substantially perpendicular to the non-conductive structural backsheet and crossing the core strips, the non-structural grid configured to comprise intersections within the open boxes, and to comprise antenna feed-lines aligned with the electrical vias; and communicating the electronic signals via the antenna feed-lines with a plurality of antenna array unit cells comprising antenna cards configured to fit within the open boxes.

20. The method of claim 19, wherein the non-structural grid of antenna feed cards comprises:

at least one horizontal pole electrical core strip comprising one of: RF interconnects configured to couple the antenna card to the non-structural grid of antenna feed cards, one or more feet configured for insertion into the non-conductive structural backsheet through the electrical vias and connectors, or at least one tab coupled to the non-conductive structural backsheet and the electrical vias; and at least one vertical pole electrical core strip comprising one of: lower connectors and upper connectors and the antenna feed-lines coupled between the lower connectors and the upper connectors, or upper connectors and tabs and the antenna feed-lines coupled between the upper connectors and the tabs.

* * * * *